US011163266B2

(12) United States Patent
Mace et al.

(10) Patent No.: US 11,163,266 B2
(45) Date of Patent: Nov. 2, 2021

(54) TIMEPIECE MECHANISM FOR RETURNING THE SECONDS HAND TO ZERO WITH A SNAIL CAM

(71) Applicant: Montres Breguet S.A., L'Abbaye (CH)

(72) Inventors: Jerome Mace, Le Pont (CH); Sebastian Alagon Carrillo, Romainmotier (CH); Alain Zaugg, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 573 days.

(21) Appl. No.: 16/178,034

(22) Filed: Nov. 1, 2018

(65) Prior Publication Data

US 2019/0155221 A1 May 23, 2019

(30) Foreign Application Priority Data

Nov. 20, 2017 (EP) ..... 17202604

(51) Int. Cl.
*G04F 7/08* (2006.01)
*G04B 27/00* (2006.01)

(52) U.S. Cl.
CPC ..... *G04F 7/0804* (2013.01); *G04B 27/001* (2013.01); *G04F 7/08* (2013.01); *G04F 7/0809* (2013.01)

(58) Field of Classification Search
CPC ..... G04B 27/001; G04F 7/08; G04F 7/0804; G04F 7/0809
See application file for complete search history.

(56) References Cited

U.S. PATENT DOCUMENTS

| | | | | |
|---|---|---|---|---|
| 377,896 A | | 2/1888 | Heuer | |
| 2,322,257 A | * | 6/1943 | Frederick | G04B 21/022 368/270 |
| 3,696,609 A | * | 10/1972 | Dubois | G04B 19/082 368/220 |
| 5,043,955 A | * | 8/1991 | Dubois | G04B 45/00 368/228 |
| 10,254,714 B2 | * | 4/2019 | Dauby | G04B 19/262 |

(Continued)

FOREIGN PATENT DOCUMENTS

| | | |
|---|---|---|
| EP | 2 224 294 A1 | 9/2010 |
| EP | 3 112 956 A1 | 1/2017 |
| WO | WO 2014/079736 A1 | 5/2014 |

OTHER PUBLICATIONS

European Search Report dated May 30, 2018 in European Application 17202604.9, filed on Nov. 20, 2017 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A timepiece mechanism for returning the seconds hand to zero, which includes a seconds arbor; a seconds hand; a cam forming a snail cam path which extends in a spiral around the seconds arbor from an inner end to an outer end connected to each other by a radial stop surface; a hammer carrying a cam follower, rotatably mounted about a hammer axis between a disengaged position wherein the cam follower is removed from the cam path and an engaged position wherein the cam follower presses on the cam path; a retaining ratchet system including a toothed wheel and a click which engages with the toothed wheel.

10 Claims, 8 Drawing Sheets

(56) References Cited

U.S. PATENT DOCUMENTS

| | | | | |
|---|---|---|---|---|
| 10,599,099 | B2 * | 3/2020 | Carrillo | G04B 19/262 |
| 2004/0218473 | A1 * | 11/2004 | Takahashi | G04F 7/0842 368/37 |
| 2007/0091727 | A1 * | 4/2007 | Bonvin | G04F 7/0847 368/107 |
| 2008/0159082 | A1 * | 7/2008 | Hiraga | G04B 19/241 368/228 |
| 2008/0304368 | A1 * | 12/2008 | Courvoisier | G04F 7/089 368/101 |
| 2010/0246341 | A1 * | 9/2010 | Papi | G04B 19/02 368/172 |
| 2014/0355393 | A1 * | 12/2014 | Graemiger | G04F 7/0823 368/80 |
| 2015/0016230 | A1 * | 1/2015 | Graemiger | G04B 19/082 368/80 |
| 2015/0016232 | A1 * | 1/2015 | Graemiger | G04B 19/025 368/132 |
| 2015/0301503 | A1 * | 10/2015 | Merdanovic | G04B 19/02 368/238 |
| 2016/0103421 | A1 * | 4/2016 | Goeller | G04B 19/24 368/28 |
| 2016/0147198 | A1 * | 5/2016 | Bravo | G04B 19/04 368/101 |
| 2018/0341224 | A1 * | 11/2018 | Alagon Carrillo | G04B 19/02 |
| 2019/0086867 | A1 * | 3/2019 | Gerber | G04B 19/202 |
| 2019/0271948 | A1 * | 9/2019 | Wiederrecht | G04F 7/0804 |
| 2019/0286058 | A1 * | 9/2019 | Zaugg | G04B 19/25393 |
| 2019/0332059 | A1 * | 10/2019 | Gerber | G04B 19/202 |
| 2020/0117142 | A1 * | 4/2020 | Denden | G04B 19/04 |
| 2021/0200159 | A1 * | 7/2021 | Feyer | G04F 7/0814 |

* cited by examiner 6
7
8
9
10
11
12
15
16
17
18
19
20
22
23
24
29
30
31
32
33
34
35
36
37
40
41
46
47
48
A1
A2
A3

TIMEPIECE MECHANISM FOR RETURNING THE SECONDS HAND TO ZERO WITH A SNAIL CAM

CROSS-REFERENCE TO RELATED APPLICATION

This application claims priority to European Patent Application No. 17202604.9 filed on Nov. 20, 2017, the entire disclosure of which is hereby incorporated herein by reference.

FIELD OF THE INVENTION

The invention concerns the field of horology. It concerns more specifically a timepiece mechanism for returning the seconds hand to zero and a watch provided with such a mechanism.

BACKGROUND OF THE INVENTION

A mechanism for returning the seconds hand to zero can be found:

in most chronograph watches, and in some watches provided with a seconds hand (known in French as a trotteuse) and in which the seconds hand is automatically returned to zero when the time is set.

Traditionally, such a mechanism includes (in addition to the seconds hand and its seconds arbor):

- a cam integral in rotation with the seconds arbor and a peripheral edge of which forms a cam path;
- a hammer carrying a cam follower, this hammer being rotatably mounted about a hammer axis between a disengaged position in which the cam follower is removed from the cam path, and an engaged position in which the cam follower presses on the cam path to produce a drive torque on the seconds arbor.

The cam is usually heart-shaped, which is why it is simply called a 'heart cam', as in the reference manual by C. A. Reymondin et al, *'Théorie d'horlogerie'* (The Theory of Horology), Fédération des Ecoles Techniques, édition 2015, p.238.

In chronographs, the return-to-zero hammer is a complex component provided with several cam followers which simultaneously strike several respective cams, integral with the hour hand, the minute hand, the seconds hand (and less frequently, with a tens hand).

In watches where the seconds hand is automatically returned to zero, such as that described in European Patent No. EP2224294 (Glasshütte), the hammer is of simpler shape, but the principle is the same.

In each case, the cam follower is usually formed by one end of the hammer in the shape of a horse's hoof, which, at the end of (angular or linear) travel, is pressed against a double bump formed on the heart cam to ensure that it is held in a stable position corresponding to the return to zero of the seconds hand.

However, this type of mechanism, which is very widespread, suffers from a number of drawbacks.

Firstly, the position of the seconds hand when it is returned to zero is usually quite random and lacks precision. This is particularly detrimental in the case of a jumping hand, which is supposed to be in a very precise angular position every second (each angular position being separated from the next by 6°).

Secondly, given the respective geometry of the heart cam and the hammer, the friction forces at their interface are not constant. This results in non-uniform wear of these components, which in the long term impairs the reliability of the mechanism.

Thirdly, in certain angular positions of the heart cam, the hammer rubs against it with a sharp edge, as illustrated in FIG. 11.29 of the aforementioned manual, which increases the concentration of stresses, wear and mechanical fatigue of such components.

Fourthly, the momentum acquired by the heart cam during its rotation means that it is not immediately braked in the end position by pressure from the end of the hammer in the seconds arbor, but, before coming to rest, still experiences damped oscillations which adversely affects the perception of precision expected by an informed user.

Fifthly, the complexity of known mechanisms makes them onerous and difficult to manufacture.

A first object is to propose a mechanism for returning the seconds hand to zero, which provides a precise position of the seconds hand exactly opposite a predetermined graduation on the dial (typically a twelve o'clock symbol).

A second object is to obtain greater reliability and consequently greater longevity.

A third object is to propose a mechanism for returning the seconds hand to zero which is of simpler design (and thus more compact, lighter and easier to manufacture) than known mechanisms.

SUMMARY OF THE INVENTION

To achieve all or part of the aforementioned objects, there is proposed, firstly, a timepiece mechanism for returning the seconds hand to zero, which includes:

- a seconds arbor;
- a seconds hand integral in rotation with the seconds arbor;
- a cam integral in rotation with the seconds arbor and a peripheral edge of which forms a cam path;
- a hammer provided with a cam follower, said hammer being rotatably mounted about a hammer axis between a disengaged position, in which the cam follower is removed from the cam path, and an engaged position, in which the cam follower presses on the cam path to produce a drive torque on the seconds arbor; said mechanism being characterized:
- in that the cam takes the form of a snail, the cam path extending in a spiral around the seconds arbor from an inner end to an outer end which are connected to each other by a stop surface which extends substantially radially relative to the seconds arbor and against which the cam follower comes into abutment in an angular end-of-travel position of the seconds hand;
- in that it includes a retaining ratchet system comprising a toothed wheel mounted on the seconds arbor, and a click carried by the cam and which engages with the toothed wheel.

As a result of this design, the mechanism remains efficient, yet is quite simple, light and compact. When returning to zero, the seconds hand can return to a precise position opposite a graduation.

Various additional characteristics can be provided, alone or in combination. Thus, for example:

- the mechanism may include a hammer spring provided with a fixed head and an elastic strip which draws the hammer towards its engaged position.
- the hammer can carry a primary protruding post, against which the spring strip permanently presses.

the mechanism can include an actuator movably mounted between a retaining position, in which it places the hammer in its disengaged position, and a release position in which it allows the hammer to occupy its engaged position.

the hammer can carry a secondary projecting post, against which a shoulder formed on the actuator presses in the retaining position of the latter.

the mechanism can include a retaining ratchet system which allows the cam to rotate in only one direction.

the ratchet or click system can include a toothed wheel mounted coaxially to the seconds arbor, and a click carried by the cam and which engages with the toothed wheel.

the hammer axis can be provided with an eccentric whose rotation causes the hammer to move by adjusting the angular end-of-travel position of the seconds hand.

Secondly, there is proposed a watch provided with such a mechanism.

According to a preferred embodiment, the watch can be provided with a dial having a graduation that includes a twelve o'clock symbol with which the hand is substantially aligned when it is in the angular end-of-travel position.

BRIEF DESCRIPTION OF THE DRAWINGS

Other features and advantages of the invention will appear in light of the following description of one embodiment, made with reference to the annexed drawings, in which.

DETAILED DESCRIPTION OF THE INVENTION

Figure 1:
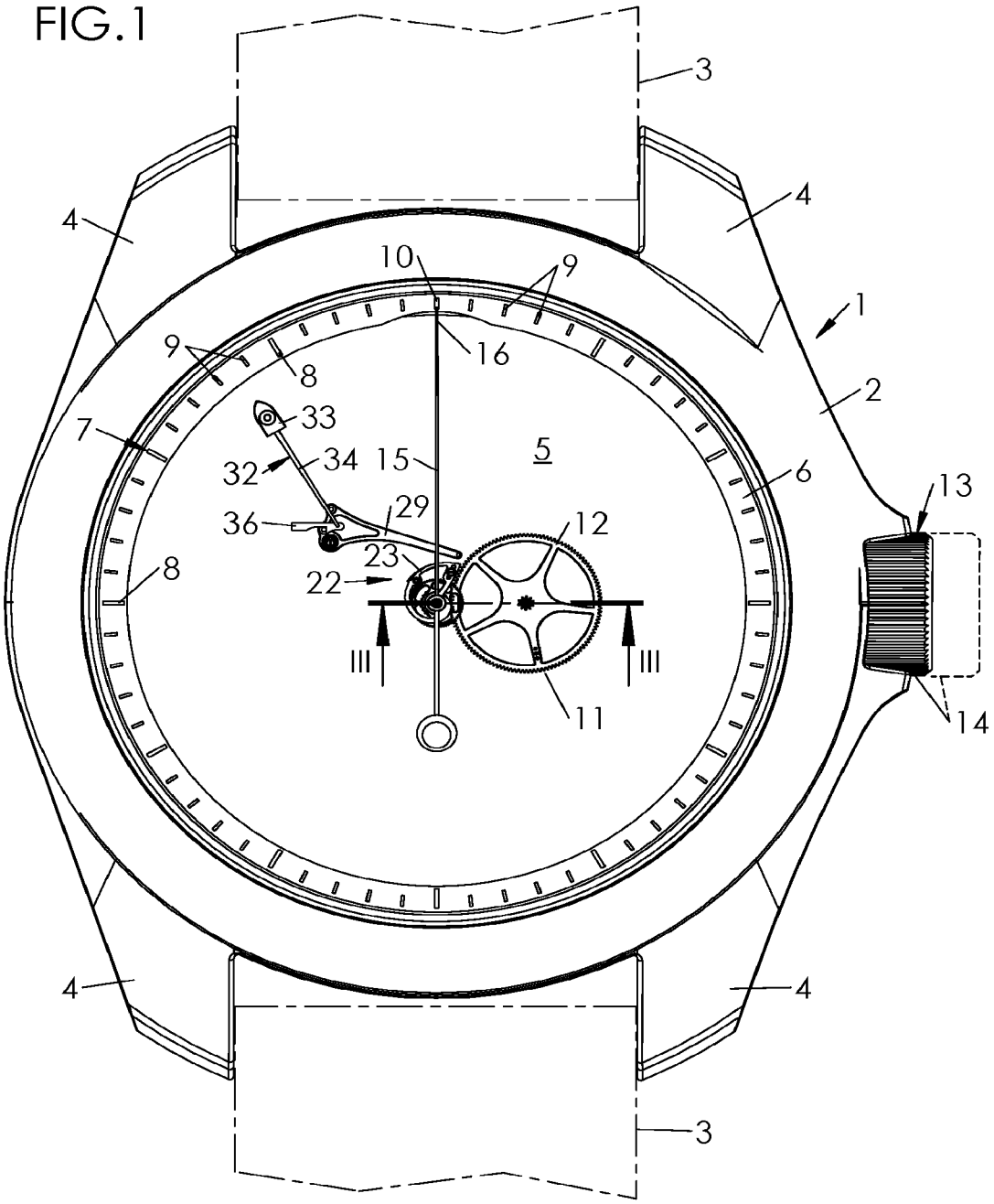
FIG. 1 is a plan view of a watch provided with a mechanism for returning the seconds hand to zero.

FIG. 1 represents a watch 1. This watch 1 includes a case middle 2, which may be made of metal (for example steel), or of a synthetic material (for example a composite material including a fibre—typically carbon—reinforced polymer matrix).

Watch 1 can include a bracelet 3 for wearing on the wrist (shown in dot and dash lines in FIG. 1) which is attached to case middle 2 between horns 4 that project from the latter.

In the illustrated example, case middle 2 has a circular case band, but this shape is not limiting. In particular, the case band could be rectangular (for example square).

Case middle 2 defines an internal space 5. To close this internal space 5, watch 1 has a crystal and a back cover (not represented), attached to either side of case middle 2.

Watch 1 is provided with a dial 6 which has a graduation 7. According to an embodiment illustrated in the drawings, and more particularly in FIG. 1, graduation 7 includes hour symbols 8 for each hour and intermediate symbols 9 for each minute. Intermediate minute symbols 9 are preferably of smaller size than hour symbols 8.

In the example illustrated, hour symbols 8 are not figurative. However, in a variant, hour symbols 8 could be figurative and take the form of numerals (for example Roman, Arabic, Gothic or Greek numerals). In any event, the graduation includes a twelve o'clock symbol 10, indicating midnight and midday for the hours, and indicating zero for the minutes and seconds.

Watch 1 includes a timepiece movement (hereinafter simply referred to as a 'movement'), which includes a plate intended to be housed inside case middle 2 and attached thereto, for example by means of screws. The plate forms a support for various mechanisms, such as the gear trains, escapement, transmission, motion-work, winding mechanism (the list is not exhaustive).

The movement includes a motion-work 11, which includes an hour wheel and a minute wheel (not represented) and a fourth wheel 12. Motion-work 11 is rotatably mounted about an axis A1.

Motion-work 11 is driven in rotation by a drive device (not represented). It is preferable for the energy source to be a mainspring associated with a balance/balance spring regulator. Nevertheless, if the energy source were a battery associated with a quartz resonator it would not be outside the scope of the invention.

Watch 1 includes an hour hand and a minute hand (not represented), for respectively displaying the hours and minutes.

The watch is provided with a time-setting mechanism 13, which includes a winding mechanism coupled to the hour and minute hands. This winding mechanism includes, in particular, a crown 14 accessible to the wearer from one side of case middle 2. Crown 14 is movable between:

a pushed-in position, illustrated in a solid line in FIG. 1 and in which crown 14 is disengaged from the hour and minute hands, which remain driven in rotation by motion-work 11, and a pulled-out position, illustrated in dotted lines in FIG. 1 and in which crown 14 is coupled to the hands to allow the time to be set.

As illustrated, watch 1 further includes a seconds hand 15 (also known as a direct drive hand), coupled to the fourth wheel 12.

Seconds hand 12 is driven in rotation, by motion-work 11, about an axis A2 around which it makes one complete revolution in one minute. In the illustrated example, seconds hand 15 is a large centre seconds hand, since its axis of rotation A2 is coincident with the central axis of dial 6.

Seconds hand 15 has a distal end 16 which, during rotation of hand 15, moves over dial 6 successively passing opposite each symbol 8, 9 of graduation 7.

Figure 3:
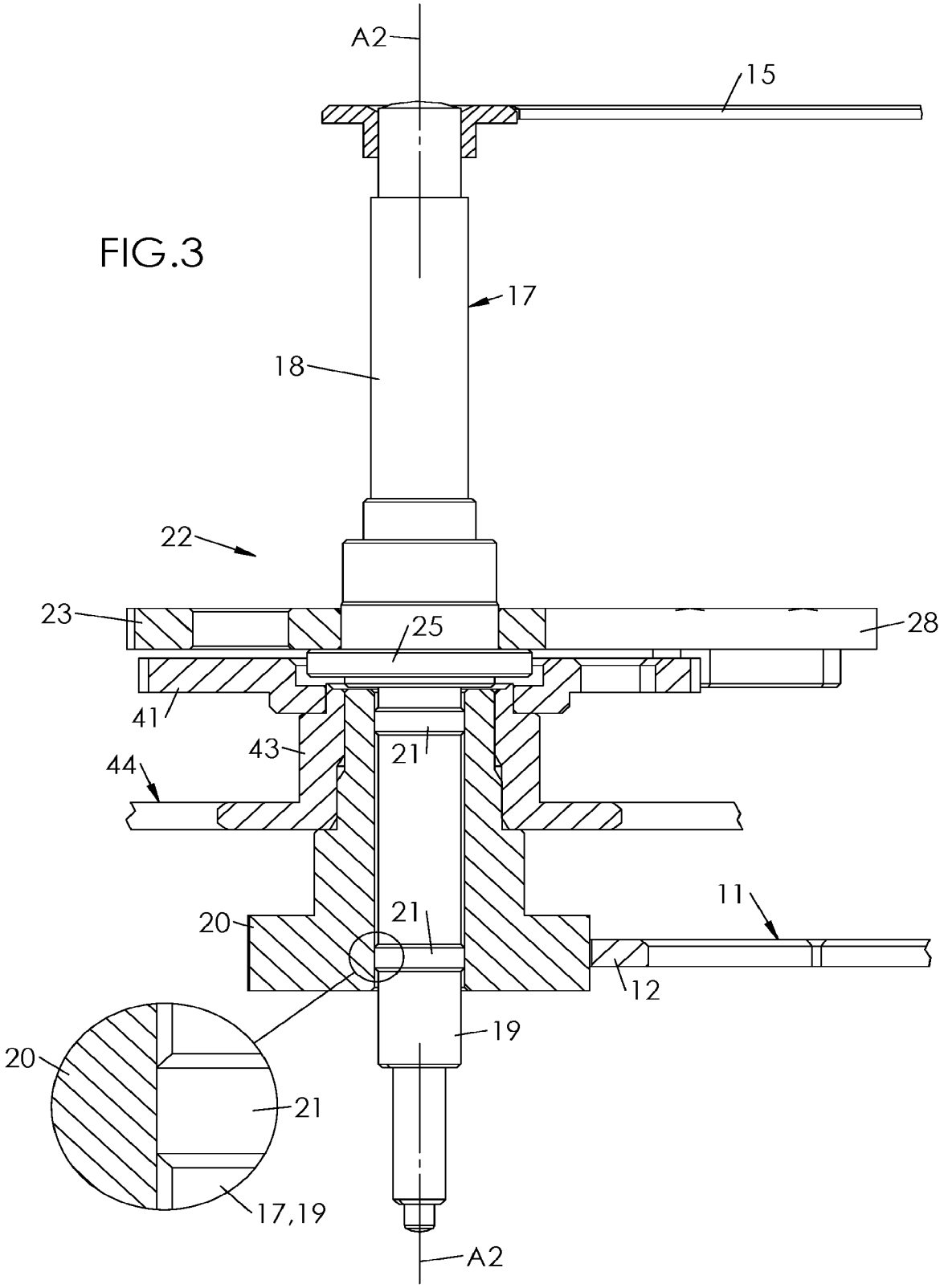
FIG. 3 is a detail cross-sectional view of the mechanism for returning the seconds hand to zero, along the cross-sectional plane III-III of FIG. 1

Seconds hand 15 is mounted (for example pressed) on seconds arbor 17 which extends along axis A2. As seen in FIG. 3, seconds arbor 17 includes an upper section 18, on which seconds hand 15 is mounted, and a lower section 19.

A pinion 20, which meshes with fourth wheel 12, is mounted on seconds arbor 17. More precisely, as illustrated in FIG. 3, pinion 20 is mounted on lower section 19 of seconds arbor 17.

As seen in FIG. 3, and more particularly in the inset detail at the bottom left, lower section 19 of seconds arbor 17 is provided with one or more flanges 21 of larger diameter, onto which pinion 20 is fitted. This results in a decreased interface between seconds arbor 17 and pinion 20.

Consequently, seconds arbor 17 and pinion 20 rotate integrally when seconds arbor 17 is not subjected to any drive (or resistance) torque applied independently of pinion 20.

However, as soon as a drive (or resistance) torque beyond a predetermined threshold is applied to seconds arbor 17 independently of pinion 20, seconds arbor 17 can rotate freely relative to pinion 20, which remains immobile since it is meshed with motion work 11. In such case, sliding occurs at the interface between seconds arbor 17 and pinion 20.

Watch 1 is provided with a timepiece mechanism 22 for returning the seconds hand to zero. By means of this mechanism 22, seconds hand 15 is disengaged from motion work 11 and repositioned in line with twelve o'clock symbol 10 (i.e. at zero) when the wearer initiates a time setting operation, particularly by pulling out crown 14.

In addition to the aforementioned seconds arbor 17 and seconds hand 15, mechanism 22 for returning the seconds hand to zero includes a cam 23 integral in rotation with seconds arbor 17 and a peripheral edge of which forms a cam path 24.

According to a preferred embodiment illustrated in the drawings, especially in FIG. 3, cam 23 is an added part tightly mounted (typically pressed) onto seconds arbor 17.

In the example illustrated in FIG. 3, cam 23 is fitted on lower section 18 of seconds arbor 17. Its height position is set by a collar 25 formed on seconds arbor 17 at the junction between upper section 18 and lower section 19, and against which cam 23 is wedged.

As seen clearly in FIG. 4 to FIG. 8, cam 23 takes the form of a snail: cam path 24 extends in a spiral around axis A2 (i.e. around seconds arbor 17) from an inner end 26 (close to axis A2) to an outer end 27 (away from axis A2). Cam path 24 is smooth, with no roughness.

Inner end 26 and outer end 27 are connected to each other by a stop surface 28 which extends substantially radially relative to the seconds arbor. Seen from the front (i.e. along axis A2), the contour of cam 23 is thus similar to the contour of the shell of a nautilus cephalopod.

Cam 23 is advantageously a metal part, for example made of steel. It is preferably perforated so that it is light and has a low moment of inertia.

Seconds hand return-to-zero mechanism 22 also includes a hammer 29 provided with a cam follower 30. This hammer 29 is rotatably mounted about a hammer axis A3 between:

- a disengaged position (FIG. 4, FIG. 8) in which cam follower 30 is removed from the cam path, and
- an engaged position, (FIG. 5, FIG. 6, FIG. 7) in which the cam follower presses on cam path 24 to produce a drive torque on seconds arbor 17.

Cam follower 30 takes the form, for example, of a lug which protrudes at a free end 31 of the hammer, at a distance from hammer axis A3. Cam follower 30 is advantageously made from a low friction coefficient material, for example a plastic material (especially polytetrafluoroethylene, also known as PTFE and Teflon®), or a precious stone (especially ruby). Cam follower 30 is advantageously rigidly fixed on hammer 29 (and cannot be disassembled therefrom). Alternatively, hammer 29 and cam follower 30 can form a one-piece element, formed from a single machined part.

During normal operation of watch 1, hammer 29 is in its disengaged position. In such case, seconds hand 15, together with seconds arbor 17, is integral with pinion 20 which is meshed with fourth wheel 12.

When a time setting operation is initiated by the user, typically by pulling out crown 14, hammer 29 is moved to its engaged position to drive in rotation, via cam follower 30 pressing on cam path 24, seconds arbor 17 (and therewith seconds hand 15)—independently of pinion 20—until seconds hand 15 is moved into an angular end-of-travel position where it is substantially in line with the twelve o'clock symbol 10 (return-to-zero).

The angular end-of-travel position of seconds hand 15 (zero position) is determined by cam follower 30 coming into abutment against stop surface 28. In this position, illustrated in FIG. 7 (and more particularly in the inset detail at the bottom middle), rotation of cam 23 (and thus of seconds arbor 17 and seconds hand 15) is stopped.

The pressure of cam follower 30 on cam path 24 is achieved by a lever-arm effect exerted on hammer 29, which tends to pivot said hammer (in the clockwise direction here) about hammer axis A3.

To this end, mechanism 22 includes a hammer spring 32. This hammer spring 32 is provided with a fixed head 33 and an elastic strip 34 which draws hammer 29 towards its engaged position.

According to one embodiment, hammer 29 carries a primary protruding post 35, against which spring strip 34 permanently presses. The lever-arm effect exerted on hammer 29 by elastic strip 34 of hammer spring 32 via primary post 35 is illustrated by the black arrow at the top of FIG. 5.

Figure 5:
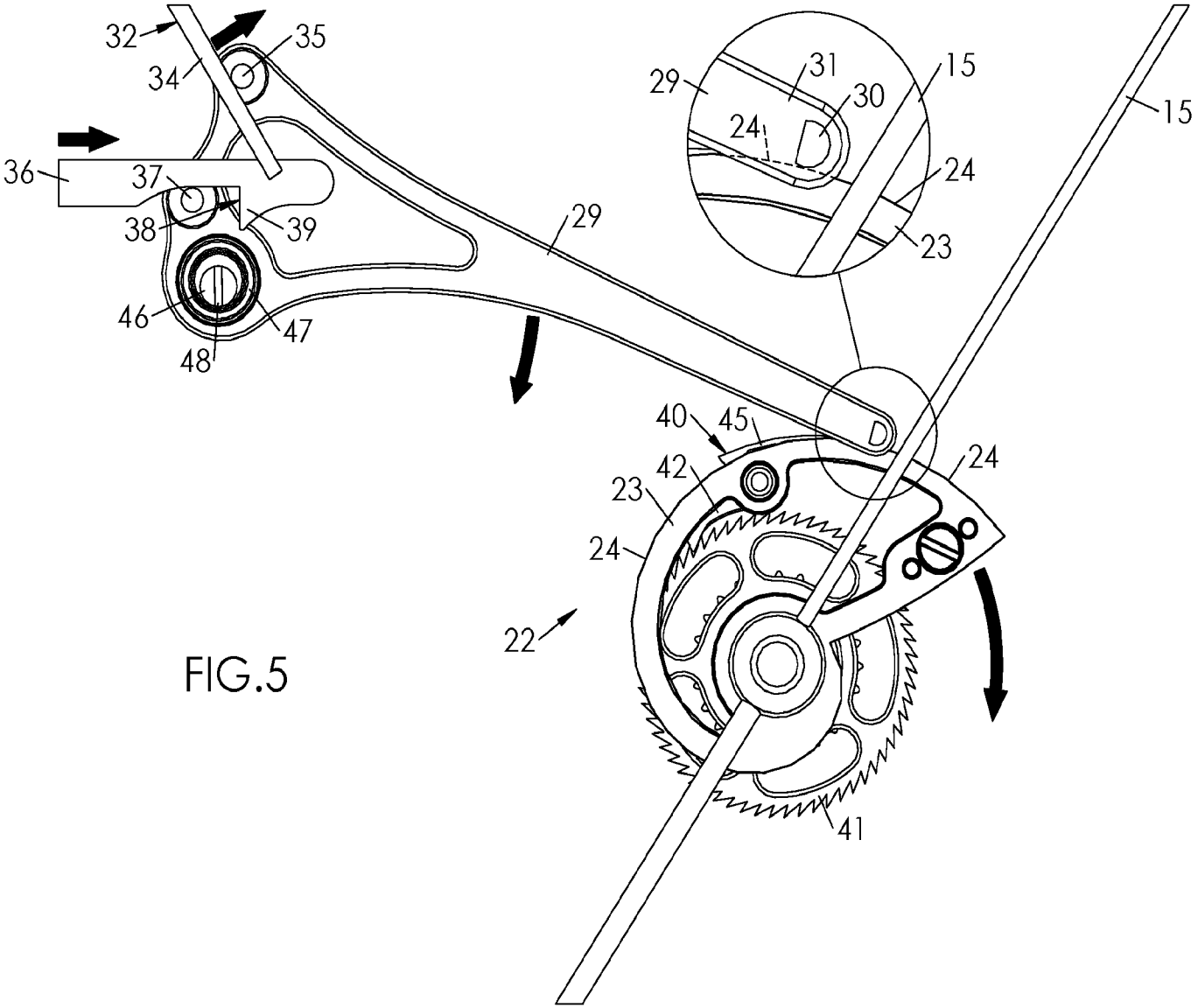

The induced rotation of hammer 29 is indicated by the black arrow in the middle of FIG. 5. This rotation brings cam follower 30 into contact with cam path 24. Since cam path 24 is smooth, and cam follower 30 has a low friction coefficient, the latter can slide freely over cam path 24.

As the lever-arm effect applied by hammer spring 32 on hammer 29 continues, cam follower 30 slides over cam surface 24 exerting thereon (and thus on cam 23) a non-concurrent stress with seconds arbor A3, which results in a drive torque being applied to cam 23 (and thus to seconds arbor 17).

Cam 23, hammer 29 and hammer spring 32 are configured such that, regardless of the angular position of cam 23, the torque induced on cam 23 by cam follower 30 is always greater than the threshold beyond which sliding is produced at the interface between seconds arbor 17 and pinion 20.

As a result, seconds arbor 17, and therewith seconds hand 15, is driven in rotation about axis A2, as illustrated by the black arrow to the bottom right of FIG. 5, cam follower 30 slides over cam surface 24 until it reaches stop surface 28, which stops dead the rotation of cam 23 (and thus of seconds hand 15).

Figure 6:
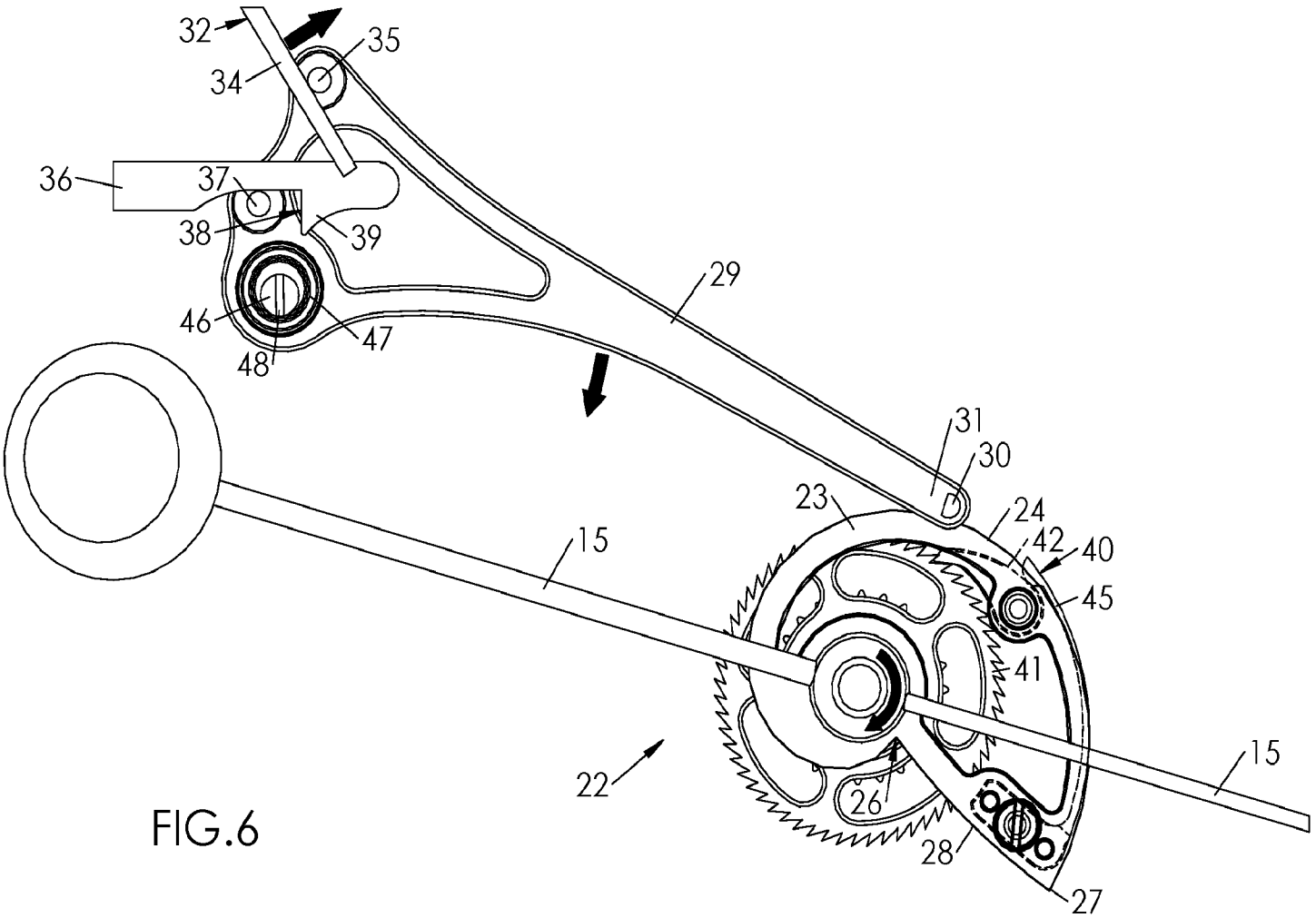
Figure 7:
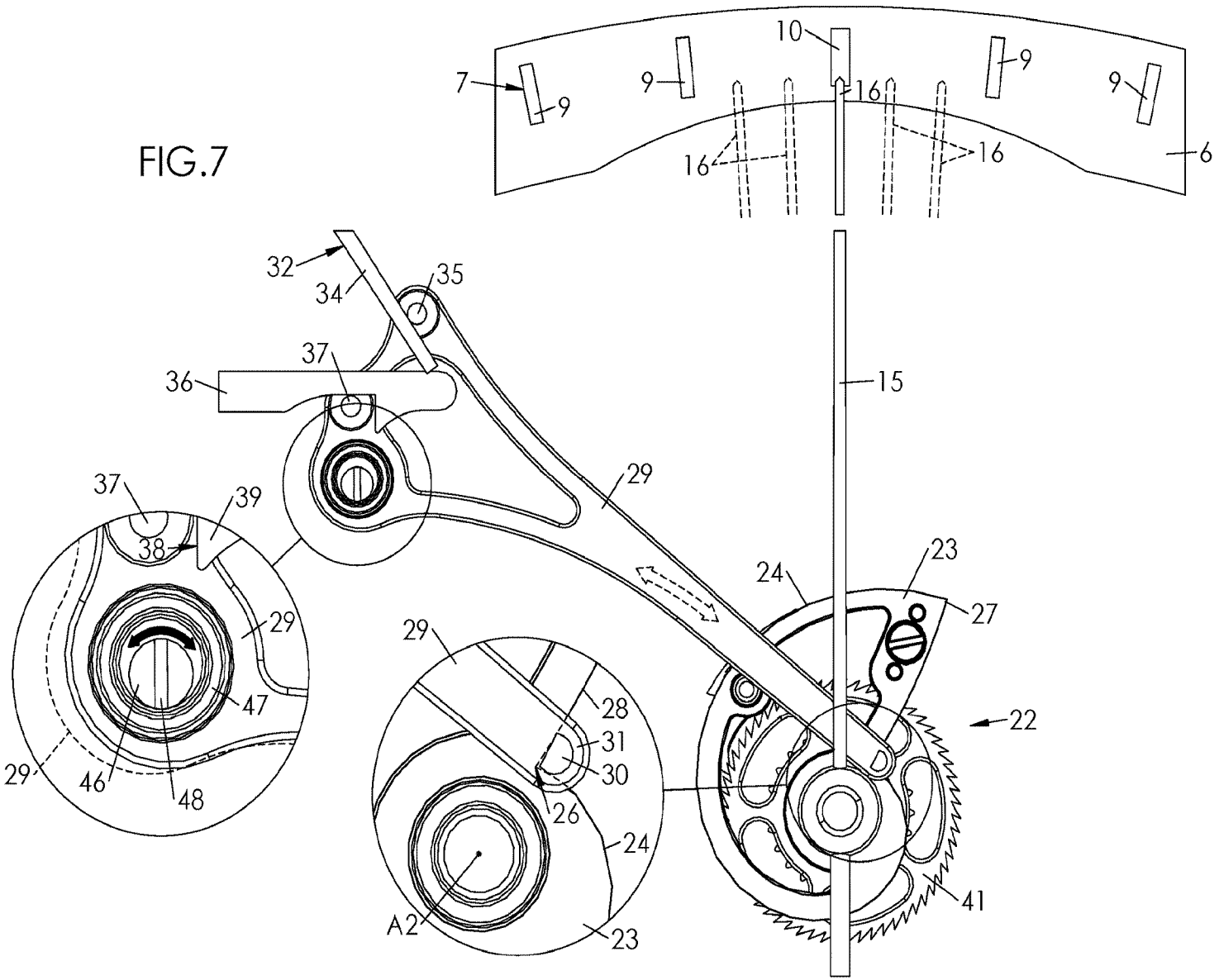

According to an embodiment illustrated in the drawings, seconds hand return-to-zero mechanism 22 includes an actuator 36 movably mounted between:

- a retaining position in which actuator 36 places hammer 29 in its disengaged position (FIG. 4, FIG. 8), and
- a release position in which actuator 26 allows hammer 29 to occupy its engaged position (FIG. 5, FIG. 6, FIG. 7).

In the illustrated example, actuator 26 takes the form of a stem mounted to move in translation (but it could be rotatably mounted).

Hammer 29 carries a secondary projecting post 37, against which a shoulder 38 formed on actuator 36 presses in the retaining position of the actuator. This shoulder 38 is, for example, defined by a claw 39 protruding from one end of actuator 36.

The movement of actuator 36 is controlled by the winding mechanism, and more precisely by crown 14. Thus, in the pushed-in position of crown 14, the latter places actuator 36 in the retaining position, which holds hammer 29 in the disengaged position and allows rotation of seconds arbor 17 (and therewith seconds hand 15) induced by motion work 11.

However, in the pulled-out position of crown 14, the latter places actuator 36 in the release position (horizontal black arrow, to the top left in FIG. 5), which allows hammer spring 32 to exert its lever-arm effect on hammer 29 to press cam follower 30 onto cam path 24.

Figure 4:
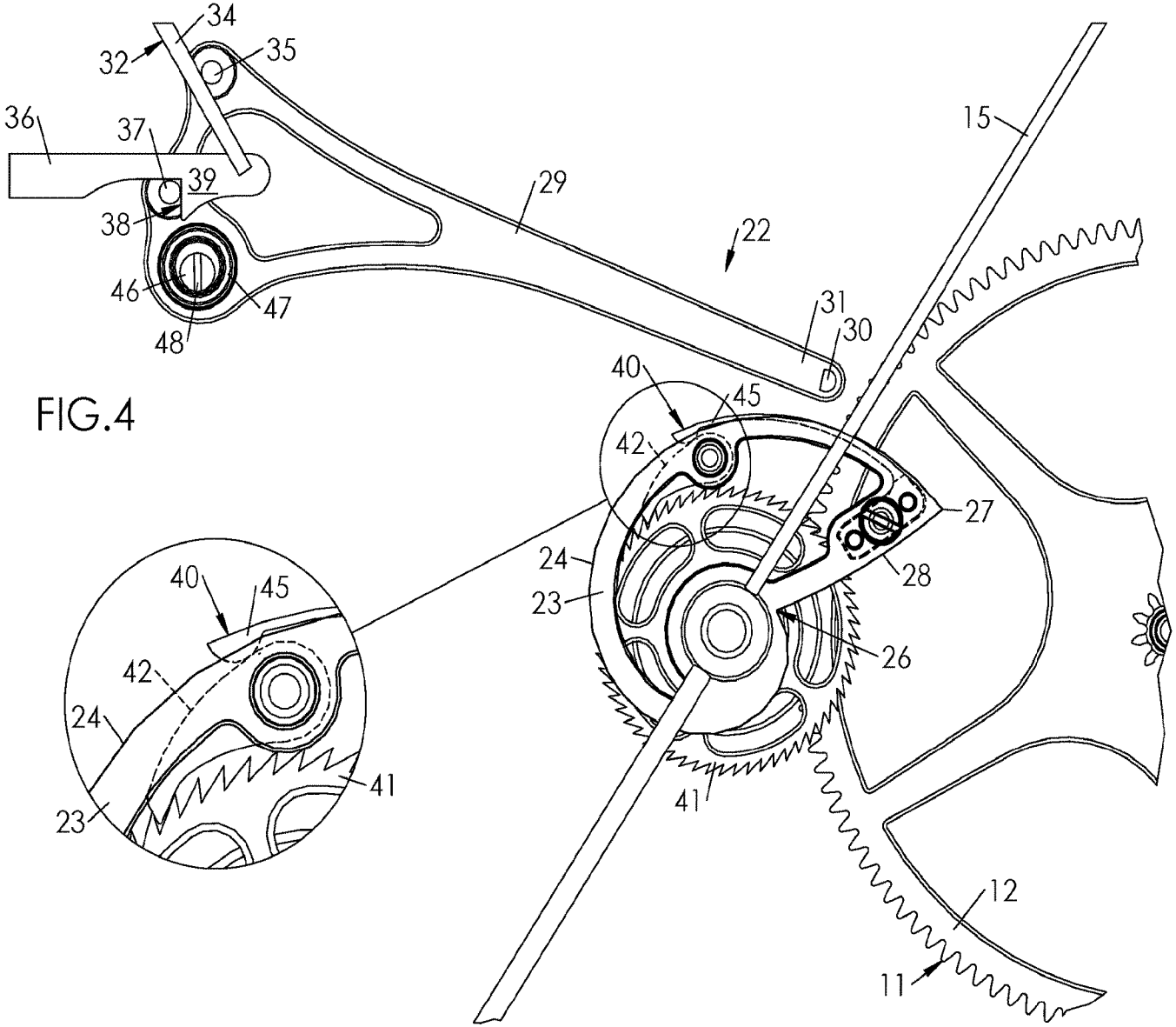
FIG. 4, FIG. 5, FIG. 6, FIG. 7 and FIG. 8 are larger scale, detail plan views of the mechanism for returning the seconds hand to zero, illustrating various phases of the operation thereof.

According to a preferred embodiment illustrated, in particular, in FIG. 4, and more particularly in the inset detail at the bottom left, seconds hand return-to-zero mechanism 22 includes a retaining ratchet system 40 which allows cam 23 to rotate in only one direction (clockwise in the illustrated example).

Ratchet or click system 40 includes a toothed wheel 41 mounted coaxially to seconds arbor 17, and a click 42 carried by cam 23 and which engages with toothed wheel 41.

Figure 2:
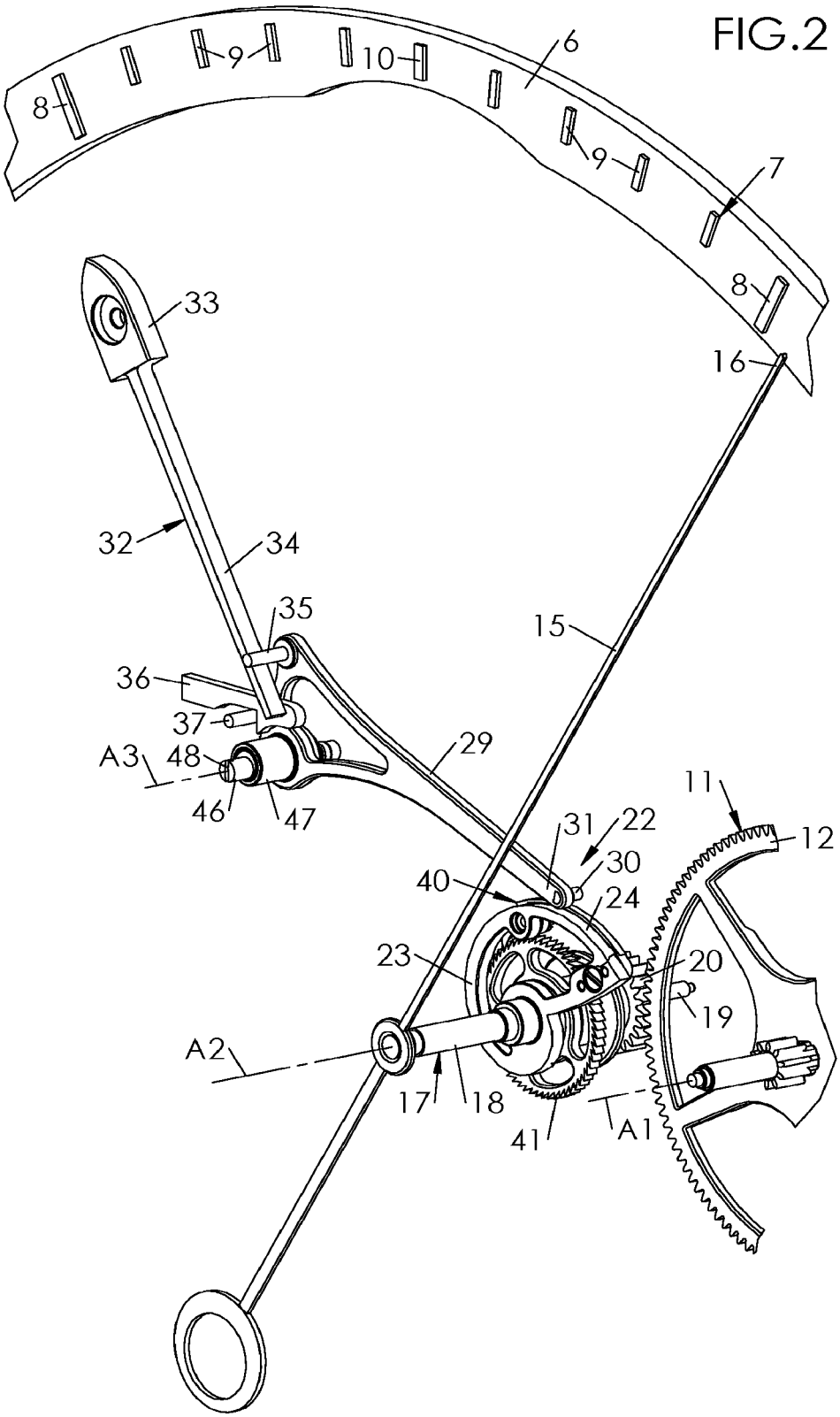
FIG. 2 is a detail perspective view of the mechanism for returning the seconds hand to zero.

More precisely, toothed wheel 41 is integral in rotation with pinion 20, where appropriate (as illustrated in FIG. 2) via a pipe 43 pressed onto pinion 20. According to one embodiment, pipe 43 is integrated in a transmission wheel 44 meshing, for example, with a striking wheel set (not represented).

According to a preferred embodiment, toothed wheel 41 is a Breguet toothing, i.e. the teeth are triangular and asymmetrical. In the illustrated example, toothed wheel 41 has sixty teeth, which each index, via click 42, a determined position of seconds hand 15 (which is then called a 'jumping hand') corresponding to each of the sixty seconds in a minute. In other words, the positions of seconds hand 15 are separated from each other by an angle of 6°.

In the example illustrated in FIG. 4, click 42 is drawn in the direction of toothed wheel 41 by means of a strip spring 45 also carried by cam 23.

Seconds hand return-to-zero mechanism 22 operates as follows.

In the pushed-in position of crown 14, the latter holds actuator 36 in the retaining position, which holds hammer 29 (and cam follower 30) in the disengaged position, away from cam 23.

Seconds arbor 17 (and therewith seconds hand 15) is integral in rotation with pinion 20, which, meshed with motion work 11, drives it in rotation about axis A2. In these conditions, seconds hand 15 performs its function as seconds hand and provides the wearer with the indication of the seconds elapsed in the current minute.

In its pulled-out position, crown 14 places actuator 36 in the release position, which allows hammer 29 to move, under the lever-arm effect provided by hammer spring 32, towards its engaged position, in which cam follower 30 is in sliding abutment on cam path 24.

As explained above, the sliding abutment of cam follower 30 on cam path 24 causes rotation of cam 23 and therewith seconds arbor 17 (which slides at its interface with pinion 20, which remains rotationally immobile about axis A2 since it is still meshed with motion work 11).

The rotation of cam 23 (in the clockwise direction) and of seconds hand 15, which is integral therewith, continues until cam follower 30 comes into abutment against stop surface 28, which stops the rotation of cam 23 (and thus of seconds arbor 17 and of seconds hand 15). Seconds hand 15 is then in its end-of-travel position and is substantially aligned with twelve o'clock symbol 10 on graduation 7 of dial 6. Click 42 is positioned between two successive teeth of toothed wheel 41, and thus stops the hand rebounding when it reaches its end position, increasing the accuracy of the return to zero function.

It may happen that seconds hand 15, at end of travel, is not exactly in line with twelve o'clock symbol 10.

To allow fine adjustment of the end of travel position of seconds hand 15, and to ensure that in this position seconds hand 15 is exactly aligned with the twelve o'clock symbol, hammer axis A3 is defined by an arbor 46 provided with an eccentric 47.

Rotation of eccentric 47 causes hammer 29 to move adjusting the angular end of travel position of seconds hand 15 (as suggested by the various positions outlined in dotted lines in FIG. 7).

The rotation of eccentric 47 is, for example, achieved by manual action, typically by means of a screwdriver. To this end, as illustrated in particular in FIG. 7, one end of eccentric 47 is formed with an imprint 48 (for example a slot) for a screwdriver. The rotation of the eccentric is illustrated in the inset detail at the bottom left of FIG. 7 (double black arrow), and its effect (in dotted lines) on the positioning of hammer 29.

Figure 8:
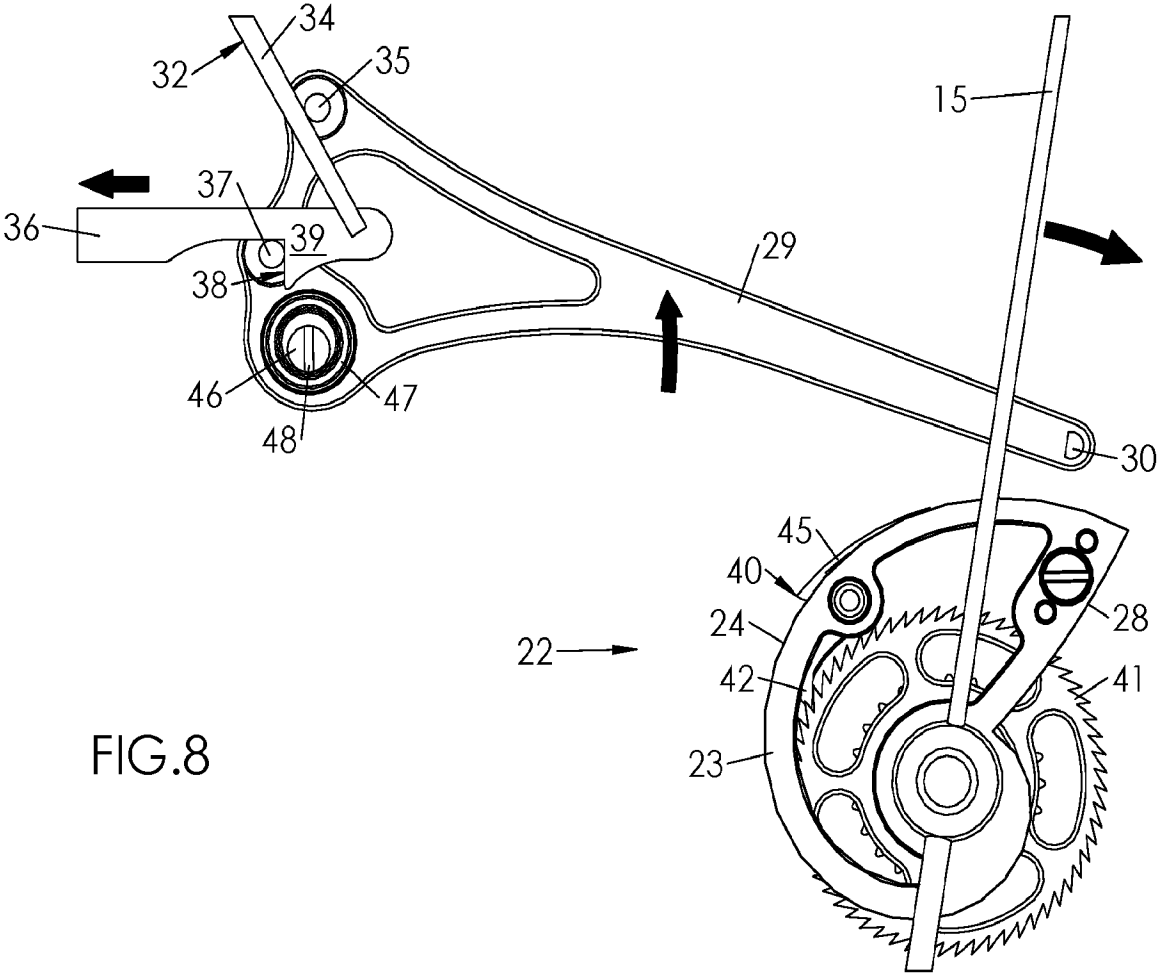

As soon as crown 14 is returned to its pushed-in position, actuator 37 is returned to its retaining position (FIG. 8). Displacement of actuator 37 exerts a traction force on secondary post 37 and drives in rotation hammer 29 against the return force of spring 32. Rotation of the hammer causes cam follower 30 to slide along stop surface 28 and then slip away from cam 23. Thereafter, no drive or resistance torque is applied to seconds arbor 17, and the friction forces at the interface between flange(s) 21 and pinion 20 rotationally couple the arbor to the pinion again.

As a result, the rotation of pinion 20, meshed with motion work 11 (and more precisely with fourth wheel 20) drives in rotation seconds arbor 17 and therewith seconds hand 15 in the usual cyclical motion.

The seconds hand return-to-zero mechanism 22 that has just been described has the following advantages.

Firstly, in comparison to known heart cam mechanisms, the present mechanism 22 is of simpler design. Hammer 29, in particular, is of less complex shape. The absence of a heel, and the presence of cam follower 30 which, at end of travel, simply comes into abutment on stop surface 28, avoids any rebounding of seconds hand 15, increasing the reliability of mechanism 22.

As already mentioned, rebound is also avoided by click system 40, which ensures the unidirectional rotation of seconds hand 15 when it is returned to zero.

Since it is simpler, this mechanism 22 is also more compact and easier to manufacture.

This results, in particular, in greater reliability, and consequently greater longevity of mechanism 22 (and therefore of watch 1).

The invention claimed is:

1. A timepiece mechanism for returning the seconds hand to zero, comprising:

a seconds arbor;

a seconds hand integral in rotation with the seconds arbor;

a cam integral in rotation with the seconds arbor and a peripheral edge of which forms a cam path;

a hammer provided with a cam follower, the hammer being rotatably mounted about a hammer axis between a disengaged position in which the cam follower is removed from the cam path, and an engaged position wherein the cam follower presses on the cam path to produce a drive torque on the seconds arbor;

the mechanism comprising:

wherein the cam takes the form of a snail, the cam path extending in a spiral around the seconds arbor from an inner end to an outer end which are connected to each other by a stop surface which extends substantially radially relative to the seconds arbor and against which the cam follower comes into abutment in an angular end-of-travel position of the seconds hand;

wherein the mechanism comprises a retaining ratchet system including a toothed wheel mounted on the seconds arbor, and a click carried by the cam and which engages with the toothed wheel.

2. The mechanism according to claim 1, wherein the mechanism comprises a hammer spring provided with a fixed head and an elastic strip which draws the hammer towards the engaged position.

3. The mechanism according to claim 2, wherein the hammer carries a primary protruding post against which the elastic strip permanently presses.

4. The mechanism according to claim 2, wherein the mechanism comprises an actuator movably mounted between a retaining position wherein the actuator places the hammer in the disengaged position, and a release position wherein the hammer can occupy the engaged position.

5. The mechanism according to claim 4, wherein the hammer carries a secondary projecting post, against which a shoulder formed on the actuator presses in the retaining position of the actuator.

6. The mechanism according to claim 1, wherein the toothed wheel has a Breguet type toothing.

7. The mechanism according to claim 6, wherein the toothed wheel has sixty teeth.

8. The mechanism according to claim 1, wherein the hammer axis is formed by an arbor provided with an eccentric whose rotation causes the hammer to move by adjusting the angular end of travel position of the seconds hand.

9. A watch provided with a timepiece mechanism for returning the seconds hand to zero according to claim 1.

10. The watch according to claim 9, provided with a dial having a graduation that comprises a twelve o'clock symbol with which the hand is substantially aligned when the hand is in the angular end of travel position.

* * * * *